US007921478B1

(12) United States Patent
Vanini

(10) Patent No.: US 7,921,478 B1
(45) Date of Patent: Apr. 12, 2011

(54) PIVOTAL SPLASH GUARD FOR A TOILET

(76) Inventor: Annmarie Vanini, Grand Island, NY (US)

( * ) Notice: Subject to any disclaimer, the term of this patent is extended or adjusted under 35 U.S.C. 154(b) by 377 days.

(21) Appl. No.: 12/157,887

(22) Filed: Jun. 12, 2008

Related U.S. Application Data

(60) Provisional application No. 60/961,427, filed on Jul. 20, 2007.

(51) Int. Cl.
*E03D 9/00* (2006.01)

(52) U.S. Cl. ..... 4/300.3; 4/468; 4/144.1; 4/DIG. 5; 4/658

(58) Field of Classification Search ..... 4/300.3, 4/658, 144.1, 450, 661; 150/154; 220/731, 220/4.03, 137
See application file for complete search history.

(56) References Cited

U.S. PATENT DOCUMENTS 1,857,328 A * 5/1932 Piper ..... 4/144.1
2,508,808 A * 5/1950 Warman ..... 4/658
2,980,919 A 4/1961 Otto et al.
3,071,778 A 1/1963 Renshaw
3,193,845 A 7/1965 Funk
3,350,722 A 11/1967 Moreschini
3,914,803 A 10/1975 Gregovski
D245,425 S 8/1977 Annis
4,060,859 A 12/1977 Anderson
4,133,062 A 1/1979 Fulbright
4,348,776 A 9/1982 Sarjeant
5,077,840 A 1/1992 Masters et al.
5,117,512 A 6/1992 Bressler
D329,893 S 9/1992 Luedtke et al.
5,216,760 A 6/1993 Brown et al.
5,276,925 A 1/1994 Blaha
5,373,589 A 12/1994 Rego et al.
5,465,431 A 11/1995 Wertz
D369,856 S 5/1996 Lucido et al.
5,564,135 A 10/1996 Jones et al.
5,625,905 A 5/1997 Woods
D394,497 S 5/1998 Johnson
D394,900 S 6/1998 Kang
5,815,851 A 10/1998 Perry
D405,168 S 2/1999 Henry
5,983,410 A 11/1999 Webster
6,032,302 A 3/2000 Eckert
6,119,282 A 9/2000 Serbin
6,253,395 B1 7/2001 Quam
6,357,055 B1 3/2002 Gambla et al.
6,385,785 B1 5/2002 Linden
D458,669 S 6/2002 Sanders
6,550,075 B1 4/2003 Brannon, III
6,874,171 B2 4/2005 Erves
(Continued)

*Primary Examiner* — Gregory L Huson
*Assistant Examiner* — Lauren Heitzer
(74) *Attorney, Agent, or Firm* — www.bobharter.com; Robert J. Harter

(57) ABSTRACT

A splash guard includes a shield that helps deflect and drain misdirected urine into a toilet bowl. When not needed, the shield can pivot 180 degrees from an operative, raised position down to tuck underneath the front end of the toilet bowl at a stored, lowered position. In the lowered position, the shield is generally inverted. To prevent residual urine on the inverted shield from dripping onto the floor, the shield includes a drip lip that temporarily collects the residual urine. When returned to the upright, raised position, urine in the drip lip is free to drain back into the toilet. The shield is pivotally connected to the toilet bowl at a point below the upper rim of the bowl so that when the shield pivots to the lowered position, the shield is completely out of the way.

14 Claims, 4 Drawing Sheets

U.S. PATENT DOCUMENTS

| | | | | |
|---|---|---|---|---|
| 7,017,198 | B2 | 3/2006 | Conn et al. | |
| 7,178,177 | B1 * | 2/2007 | Valencia | 4/300.3 |
| 2002/0038475 | A1 | 4/2002 | Garrett et al. | |
| 2004/0237181 | A1 | 12/2004 | Atkins-Williams | |
| 2005/0055757 | A1 | 3/2005 | Boals | |
| 2005/0193482 | A1 * | 9/2005 | Gambla et al. | 4/300.3 |
| 2005/0198727 | A1 | 9/2005 | Conn | |
| 2006/0041998 | A1 | 3/2006 | Lattanzi | |
| 2007/0089225 | A1 | 4/2007 | Wolf | |
| 2007/0271690 | A1 | 11/2007 | Revelo | |

* cited by examiner

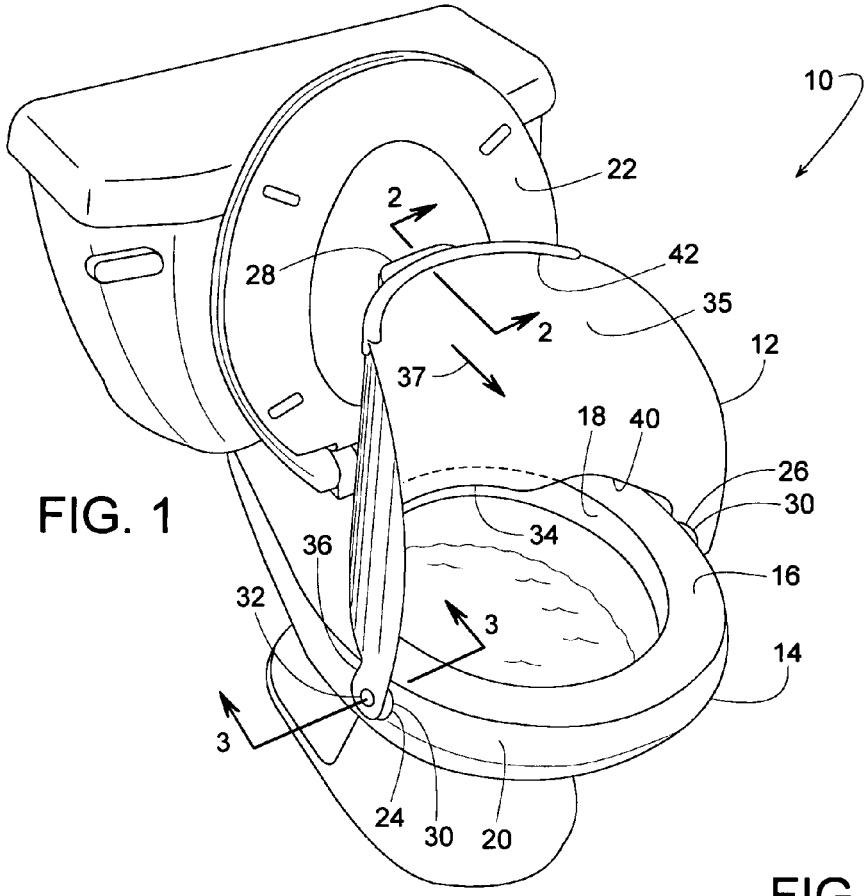
FIG. 1
FIG. 2
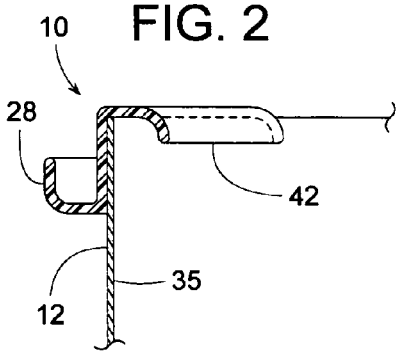
FIG. 3
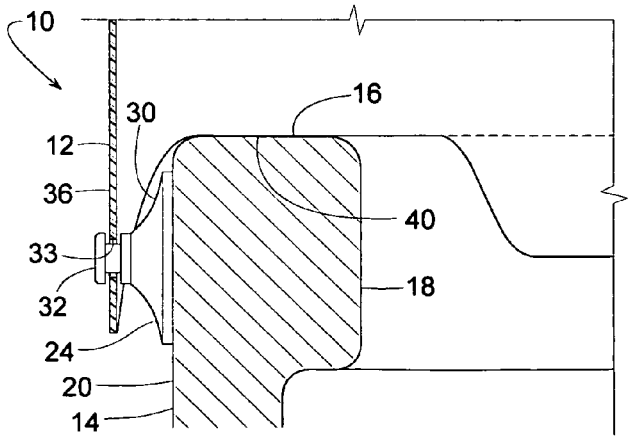

PIVOTAL SPLASH GUARD FOR A TOILET

CROSS-REFERENCE TO RELATED APPLICATIONS

This application claims the benefit of provisional patent application Ser. No. 60/961,427, filed Jul. 20, 2007 by the present inventor.

FIELD OF THE INVENTION

The subject invention generally pertains to toilets and more specifically to a splash guard for a toilet.

BACKGROUND

Various splash and urine guards have been developed for use on toilets. Typical examples are disclosed in U.S. Pat. Nos. 5,117,512; D369,856; 7,178,177 and 7,017,198. It appears that each of these guards are standalone devices that have to be disconnected from the toilet bowl in order for a person to use the toilet seat. If there happens to be any residual urine on the guard, that urine might drip on the floor or other surface upon which the guard is placed while the guard is not in use.

Another urine guard, disclosed in U.S. Pat. No. 3,914,803, overcomes the storage problem by having the guard pivot down when not in use. A drawback of this design, however, is that the side shields of the guard lie beyond the outer perimeter of the toilet bowl, thus it appears that urine caught by the inner surface of the guard would tend to drain onto the floor, rather than into the toilet bowl.

BRIEF SUMMARY

It is an object of present invention to provide a splash guard pivotally connectable to a toilet bowl so that a shield portion of the guard can pivot between an operative, raised position and a stored, lowered position.

Another object of some embodiments is to provide the splash guard with a fixed point of attachment that is below the upper rim of the toilet bowl so that the shield can pivot completely out of the way.

Another object of some embodiments is to pivot the shield of a splash guard at least 90 degrees and preferably 180 degrees or more so that the shield can partially tuck underneath the toilet bowl when the guard is in storage.

Another object of some embodiments is to provide a urine shield with a drip lip that collects residual urine when the shield is generally inverted in its stored, lowered position.

Another object of some embodiments is to provide urine shield with a combination drip lip and handle, wherein the drip lip and handle are a unitary piece.

One or more of these and/or other objects of the invention are provided by a splash guard that is pivotally connected to toilet bowl such that a shield of the splash guard can pivot between an operative, raised position and a stored, lowered position.

BRIEF DESCRIPTION OF THE DRAWINGS

FIG. 1 is a perspective view of a splash guard mounted to a toilet bowl, wherein a shield of the guard is at an operative, raised position.

FIG. 2 is a cross-sectional view taken alone line 2-2 of FIG. 1.

FIG. 3 is a cross-sectional view taken along line 3-3 of FIG. 1.

DETAILED DESCRIPTION

Figure 4:
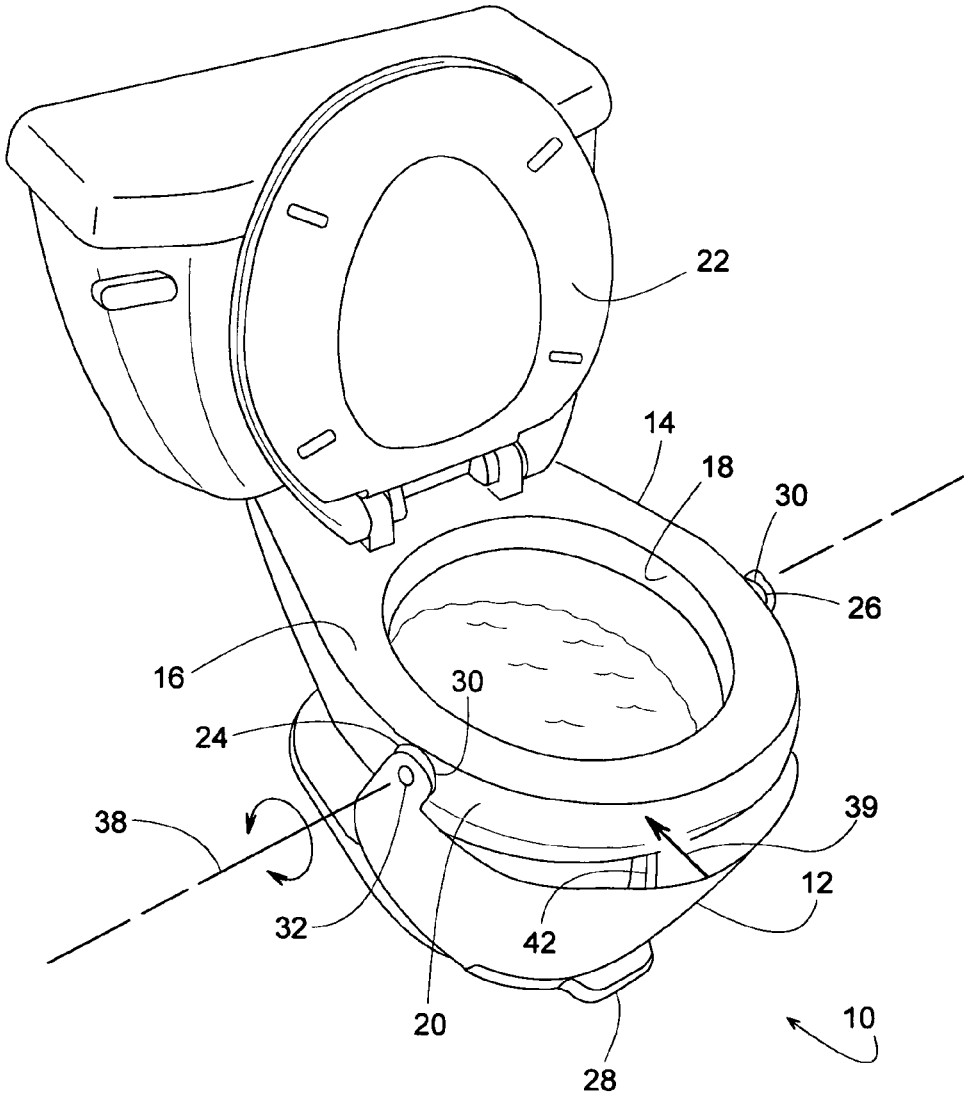
FIG. 4 is a perspective view similar to FIG. 1 but showing the shield in a stored, lowered position.

FIGS. 1-4 show a splash guard 10 with a shield 12 that helps deflect and drain misdirected urine into a toilet bowl 14. Toilet bowl 14 includes an upper rim 16, a concave inner surface 18, and a convex outer surface 20. A pivotal toilet seat 22 might also be attached to toilet bowl 14.

A first anchor 24 and a second anchor 26 pivotally connect shield 12 to toilet bowl 14 so that shield 12 can pivot between an operative, raised position of FIG. 1 (when in use) and a stored, lowered position FIG. 4 (when not in use). A handle 28 helps in manually pivoting shield 12. Shield 12 can be made of various materials including, but not limited to, semi-rigid or flexible PVC, polystyrene, polycarbonate, etc. The material thickness of shield 12 can be 0.040 inches or some other suitable thickness.

In this particular example, anchors 24 and 26 each are in the form of a suction cup 30 that can stick to convex outer surface 20; however, anchors 24 and 26 could be of various other designs as well. Suction cup 30 includes a head 32 with a circumferential groove that rotatably fits within a hole 33 in shield 12. Thus, suction cups 30 remain substantially stationary, while shield 12 can rotate or pivot relative to suction cups 30.

To ensure that shield drains misdirected urine into toilet bowl 14 when shield 12 is in the raised position, shield 12 preferably extends partially down into the toilet bowl. A central section 34 of shield 12, for instance, overlaps inner surface 18 of bowl 14, as shown in FIG. 1. However, to enable shield 12 to swing completely out of the way when not in use, an arm section 36 of shield 12 overlaps outer surface 20 to reach the external pivotal connection of suction cups 30, whereby such an external connection allows shield 12 to pivot more than 90 degrees and preferably at least 180 degrees about an axis 38 (defined by anchors 24 and 26) that is below upper rim 16. To help hold shield 12 at its raised position, an intermediate section 40 of shield 12, between sections 34 and 36, can rest upon upper rim 16, as shown in FIGS. 1 and 3.

While shield 12 can effectively deflect and drain urine into toilet bowl 14 when shield 12 is in the raised position of FIG.

1, to prevent residual urine on the inner surface of shield 12 (urine-deflection surface 35) from later dripping onto the floor when shield 12 is rotated back down to its stored position of FIG. 4, shield 12 includes a drip lip 42 that collects and temporarily holds that residual urine, when surface 35 is facing in a backward direction 39. When shield 12 is tilted back up to its raised position, with surface 35 facing in a forward direction 37, the urine collected in drip lip 42 can drain back down into toilet bowl 14.

Drip lip 42 can be an integral part of handle 28, i.e., lip 42 and handle 28 can be a unitary piece as shown in FIG. 2. Handle 28 and/or lip 42 can be connected to shield 12 by any suitable method including, but not limited to, adhesively bonding, thermally bonding, mechanically fastening, snap-fit connection, etc. Lip 42 and handle 28 can also be two separate pieces as shown in some of the other examples herein. In some cases, lip 42 can be an integral part of shield 12, wherein lip 42 and shield 12 would be a unitary piece.

Figure 5:
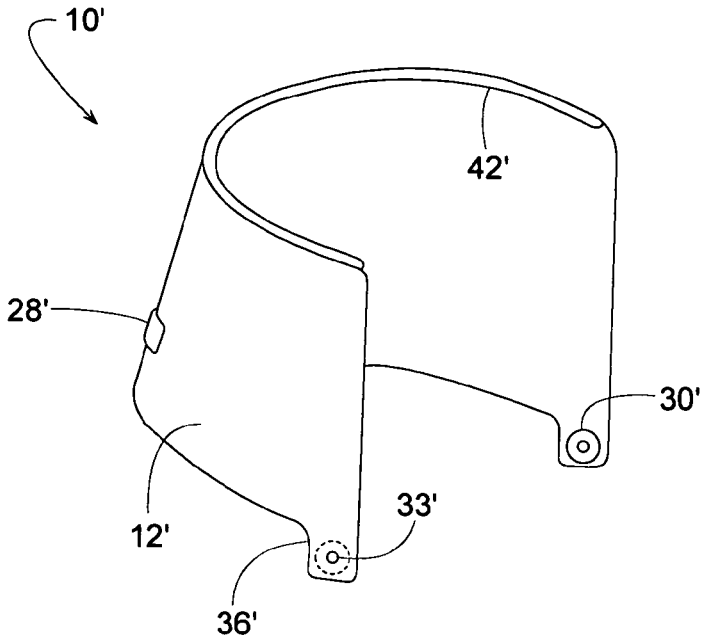
FIG. 5 is a perspective view of another splash guard.

FIG. 5 illustrates a splash guard 10' similar to splash guard 10; however, a drip lip 42' and a handle 28' are two separate pieces that are attached to a shield 12'. Alternatively, drip lip 42' and/or handle 28' can be an integral extension of shield 12'. For the example of FIG. 5, drip lip 42' is a U-shaped edging around the top of shield 12'. This feature is used to catch any excess urine or water from dripping onto the floor when shield 12' is flipped down to the storage position. Shield 12' is the main part of splash guard 10' which blocks the urine from hitting the toilet tank hinges, bathroom wall or floors. Handle 28' is used to flip shield 12' up or down during use or storage. An arm portion 36' of shield 12' extends to the outer portion of the toilet bowl for attachment. Suction cup 30' is used to attach shield 12' to the outside of the toilet bowl. A rotating hole 33' holds suction cup 30 to shield 12' and allows for movement of shield 12' around the toilet bowl.

Figure 6:
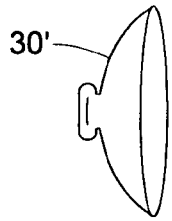
FIG. 6 is one example of an anchor for pivotally coupling a shield to a toilet bowl.
Figure 7:
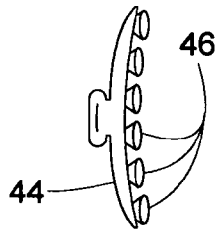
FIG. 7 is another example of an anchor for pivotally coupling a shield to a toilet bowl.

FIG. 6 shows suction cup 30' that can serve as a pivotal anchor for shields 12 or shield 12'. FIG. 7 shows an alternate anchor 44 for shields 12 or 12', wherein each anchor 44 includes two or more suction cup elements 46. Anchor 30' or 44 might be preferred depending on the contour of the toilet bowl's outer convex surface.

Figure 8:
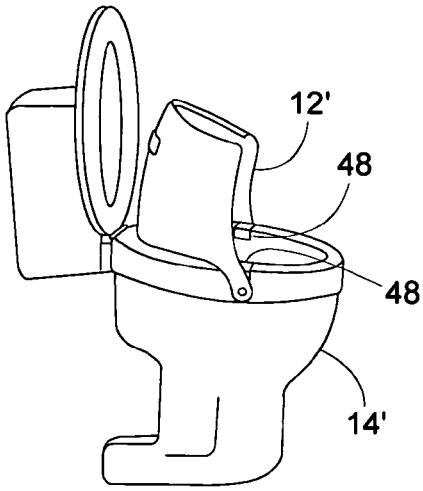
FIG. 8 is a perspective view of a splash guard pivotally mounted to a toilet bowl via the anchor shown in FIG. 9.
Figure 9:
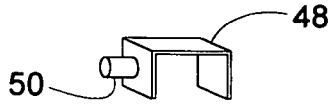
FIG. 9 is another example of an anchor for pivotally coupling a shield to a toilet bowl.

FIGS. 8 and 9 show how a channel bracket 48 or clamp can be used instead of a suction cup for providing a pivotal anchor for shields 12 or 12'. The channel portion of bracket 48 fits over rim 16, and a cantilevered shaft 50 extends into hole 33' to enable shield 12 or 12' to pivot between their raised and lowered positions.

Figure 10:
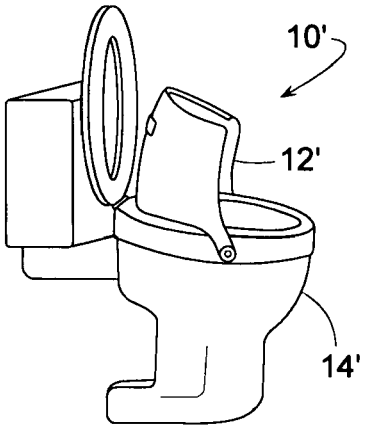
FIG. 10 is a perspective view of a splash guard mounted to a toilet bowl, wherein a shield of the guard is at a raised position.
Figure 13:
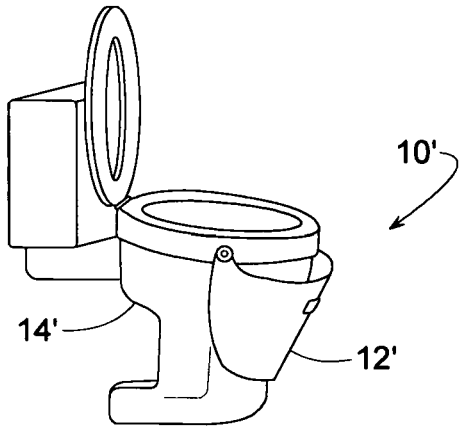
FIG. 13 is a perspective view similar to FIG. 10 but with the shield in its lowered position.
Figure 11:
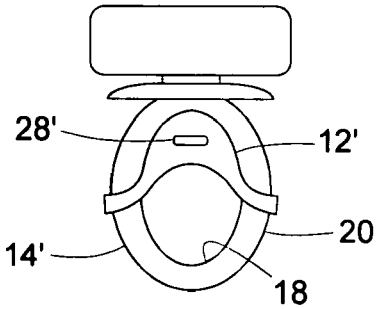
FIG. 11 is a top view of the splash guard and toilet bowl shown in FIG. 10.
Figure 14:
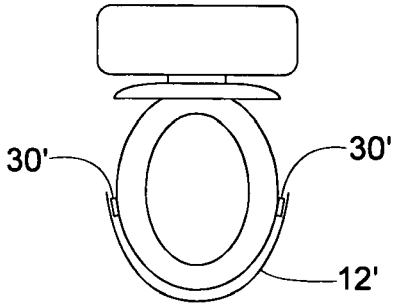
FIG. 14 is a top view similar to FIG. 11 but with the shield in its lowered position.
Figure 12:
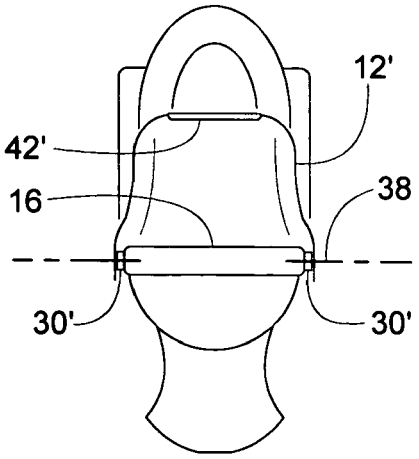
FIG. 12 is a front view of the splash guard and toilet bowl shown in FIG. 10.
Figure 15:
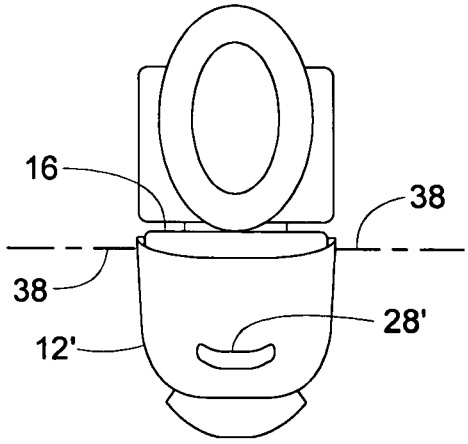
FIG. 15 is a front view similar to FIG. 12 but with the shield in its raised position.

FIGS. 10-15 show various views of splash guard 10' with respect to a toilet bowl 14' to which guard 10' is attached. FIGS. 10, 11 and 12 show splash guard 10' in a raised position, with FIGS. 10, 11 and 12 being perspective, top, and front views respectively. FIGS. 13, 14 and 15 show splash guard 10' in a lowered position, with FIGS. 13, 14 and 15 being perspective, top, and front views respectively.

Although the invention is described with respect to a preferred embodiment, modifications thereto will be apparent to those of ordinary skill in the art. The scope of the invention, therefore, is to be determined by reference to the following claims:

The invention claimed is:

1. A splash guard for a toilet bowl, wherein the toilet bowl has an upper rim, a concave inner surface, and a convex outer surface, the splash guard comprising:

a first anchor attachable to the convex outer surface of the toilet bowl;

a second anchor attachable to the convex outer surface of the toilet bowl, the first anchor and the second anchor are spaced apart from each other to define an axis that is below the upper rim when the splash guard is attached to the toilet bowl; and a shield including a central section, two arm sections, an intermediate section, and a urine-deflection surface, all of which are adjoined, the intermediate section being between the central section and one of the two arm sections, the two arm sections pivotally connect the shield to the first anchor and the second anchor such that the shield is rotatable relative to the first anchor and the second anchor and is selectively movable between a raised position and a lowered position upon pivoting about the axis such that:

a) in the raised position, the central section extends down into the toilet bowl and overlaps the inner surface of the toilet bowl, the intermediate section rests upon the upper rim of the toilet bowl, and the urine-deflection surface faces forward with reference to the toilet bowl; and b) in the lowered position, the central section is displaced out from within the toilet bowl, the intermediate section is spaced apart from the upper rim of the toilet bowl, and the urine-deflection surface faces backward with reference to the toilet bowl.

2. The splash guard of claim 1, wherein the shield rotates appreciably more than 90 degrees upon rotating from the raised position to the lowered position.

3. The splash guard of claim 1, wherein the shield rotates at least 180 degrees upon rotating from the raised position to the lowered position.

4. The splash guard of claim 1, further comprising a drip lip disposed on the shield, wherein the drip lip is above the upper rim when the shield is in the raised position, and the drip lip is below the upper rim when the shield is in the lowered position.

5. The splash guard of claim 1, wherein the first anchor comprises a suction cup that sticks to the convex outer surface of the toilet bowl.

6. The splash guard of claim 4, further comprising a handle disposed on the shield, wherein the handle and the drip lip are a unitary piece.

7. The splash guard of claim 1, further comprising a handle disposed on the shield, wherein the handle is above the upper rim when the shield is in the raised position, and the handle is below the upper rim when the shield is in the lowered position.

8. The splash guard of claim 1, wherein the shield in the raised position overlaps both the concave inner surface and the convex outer surface.

9. The splash guard of claim 1, wherein the toilet bowl supports a toilet seat, and the shield is interposed between the toilet seat and the upper rim when the shield is in the raised position, and the shield is displaced out from between the toilet seat and the upper rim when the shield is in the lowered position.

10. A splash guard for a toilet bowl, the splash guard comprising:

a first anchor attachable to a convex outer surface of the toilet bowl;

a second anchor attachable to the convex outer surface of the toilet bowl, the first anchor and the second anchor are spaced apart from each other to define an axis that is below the upper rim when the splash guard is attached to the toilet bowl; and a shield including a central section, two arm sections, an intermediate section, and a urine-deflection surface, all of which are adjoined, the intermediate section being between the central section and one of the two arm sections, the two arm sections pivotally connect the shield to the first anchor and the second anchor such that the shield is rotatable relative to the first anchor and the second anchor and is selectively movable between a raised position and a lowered position upon pivoting appreciably more than 90 degrees about the axis such that:

a) in the raised position, the central section extends down into the toilet bowl and overlaps the inner surface of the toilet bowl, the intermediate section rests upon the upper rim of the toilet bowl, and the urine-deflection surface faces forward with reference to the toilet bowl; and b) in the lowered position, the central section is displaced out from within the toilet bowl, the intermediate section is spaced apart from the upper rim of the toilet bowl, and the urine-deflection surface faces backward with reference to the toilet bowl; and a drip lip disposed on the shield, wherein the drip lip is above the first anchor and the second anchor when the shield is in the raised position, and the drip lip is below the first anchor and the second anchor when the shield is in the lowered position.

11. The splash guard of claim 10, wherein the shield rotates at least 180 degrees upon rotating from the raised position to the lowered position.

12. The splash guard of claim 10, further comprising a handle disposed on the shield, wherein the handle and the drip lip are a unitary piece.

13. The splash guard of claim 10, wherein the toilet bowl supports a toilet seat, and the shield is interposed between the toilet seat and the toilet bowl when the shield is in the raised position, and the shield is displaced out from between the toilet seat and the toilet bowl when the shield is in the lowered position.

14. The splash guard of claim 10, wherein the first anchor includes a first suction cup, and the second anchor includes a second suction cup.

* * * * *